US008912998B2

(12) United States Patent
Koyama et al.

(10) Patent No.: US 8,912,998 B2
(45) Date of Patent: Dec. 16, 2014

(54) LUMINANCE CONTROL DEVICE, DISPLAY APPARATUS USING THE SAME, LUMINANCE CONTROL METHOD AND LUMINANCE CONTROL PROGRAM

(75) Inventors: Daisuke Koyama, Osaka (JP); Osamu Mamba, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 373 days.

(21) Appl. No.: 13/321,791

(22) PCT Filed: May 21, 2010

(86) PCT No.: PCT/JP2010/058638

§ 371 (c)(1),
(2), (4) Date: Nov. 21, 2011

(87) PCT Pub. No.: WO2010/134600

PCT Pub. Date: Nov. 25, 2010

(65) Prior Publication Data

US 2012/0062622 A1 Mar. 15, 2012

(30) Foreign Application Priority Data

May 22, 2009 (JP) ..... 2009-124525

(51) Int. Cl.
*G09G 3/34* (2006.01)

(52) U.S. Cl.
CPC ..... *G09G 3/3406* (2013.01); *G09G 2320/0238* (2013.01); *G09G 2320/0646* (2013.01); *G09G 2320/0653* (2013.01); *G09G 2360/16* (2013.01)
USPC ..... 345/102; 345/690

(58) Field of Classification Search
USPC ..... 345/102, 690
See application file for complete search history.

(56) References Cited

U.S. PATENT DOCUMENTS

2003/0146919 A1 8/2003 Kawashima et al.
2004/0207609 A1 10/2004 Hata et al.

(Continued)

FOREIGN PATENT DOCUMENTS

JP 2001-75529 A 3/2001
JP 2003-36063 A 2/2003

(Continued)

OTHER PUBLICATIONS

International Search Report, dated Jun. 22, 2010, issue in PCT/JP2010/058638.

*Primary Examiner* — William Boddie
*Assistant Examiner* — Andrew Schnirel
(74) *Attorney, Agent, or Firm* — Birch, Stewart, Kolasch & Birch, LLP

(57) ABSTRACT

Power consumption is cut down by reducing backlight light source luminance in accordance with the variability of luminance of the picture displayed on a display panel. A picture luminance detector calculates information (luminance information) representing luminance of the picture at intervals of a time unit. A picture luminance storage is a memory capable of storing the past records of luminance information within a fixed period of time (some seconds to some ten seconds). A processor is configured of a variation detector and a light source luminance determiner. Variation detector performs detection of the variability of picture luminance based on the luminance information on the current picture detected by picture luminance detector and the past records of picture luminance information stored in picture luminance storage to output variation information. Light source luminance determiner determines light source luminance based on the luminance information on the current picture detected by picture luminance detector and the variation information output from variation detector and outputs a light source information control signal.

5 Claims, 18 Drawing Sheets

(56) References Cited

U.S. PATENT DOCUMENTS

| | | | | |
|---|---|---|---|---|
| 2006/0221260 | A1* | 10/2006 | Fujine et al. | 348/790 |
| 2007/0040779 | A1* | 2/2007 | Baba et al. | 345/87 |
| 2008/0030450 | A1 | 2/2008 | Yamagishi et al. | |
| 2008/0117153 | A1* | 5/2008 | Fujine et al. | 345/89 |
| 2008/0165117 | A1* | 7/2008 | Jung et al. | 345/102 |

FOREIGN PATENT DOCUMENTS

| | | | |
|---|---|---|---|
| JP | 2004-245896 | A | 9/2004 |
| JP | 2004-287420 | A | 10/2004 |
| JP | 2008-134277 | A | 6/2008 |
| JP | 2008-225026 | A | 9/2008 |
| JP | 2009-27550 | A | 2/2009 |

* cited by examiner (a)

(b)

LUMINANCE CONTROL DEVICE, DISPLAY APPARATUS USING THE SAME, LUMINANCE CONTROL METHOD AND LUMINANCE CONTROL PROGRAM

TECHNICAL FIELD

The present invention relates to a luminance control device that can cut down power consumption by controlling the luminance of the light source such as backlight of a liquid crystal panel or the like, a display apparatus using this, a luminance control method and a luminance control program.

BACKGROUND ART

Recently, displays (such as liquid crystal panel and the like) of a type that does not emit light from the display panel itself that displays a picture have been widely used. In order to provide luminance in a display of this type, a light source is arrayed on the backside of the display panel. In such a display, the most of power is consumed by the light source. Upon this, there has been an idea that can hold down power consumption by monitoring luminance variation of the input picture, detecting a time at which change of luminance is unlikely to be perceived based on the nature of human visual sensation and reducing the luminance of the light source in conformity with the time.

Patent Document 1 discloses a display apparatus that can lower power consumption by reducing luminance in such a degree that it will not cause human to have a strange visual sensation when the image will not produce a significant visual change if luminance is reduced.

FIG. 19 is a diagram showing four displayed image examples different in average luminance level and peak luminance level. A displayed image 101 is one that is high in average luminance level and low in peak luminance level; a displayed image 102 is one that is high in average luminance level and high in peak luminance level; a displayed image 103 is one that is low in average luminance level and low in peak luminance level; and a displayed image 104 is one that is low in average luminance level and high in peak luminance level. In the technology of Patent Document 1, of these images a displayed image having a low average luminance level and a high peak luminance level as displayed image 104, is regarded as a low change image that will not produce a significant change in visual sensation on the display screen even if luminance is lowered, and luminance is reduced when a displayed image of this type is detected.

PRIOR ART DOCUMENT

Patent Document

Patent Document 1:
Japanese Patent Application Laid-open 2001-75529

SUMMARY OF THE INVENTION

Problems to be solved by the Invention

However, in the control of Patent Document 1, the opportunity of reducing luminance is markedly limited, so that the control is only applicable to displayed image 104 having a low average luminance level and a high peak luminance level. With this performance, the effect of reduction in power consumption is also limited.

In view of the above circumstances, it is therefore an object of the present invention to provide a luminance control device that can cut down power consumption by reducing the light source luminance of backlight in conformity with luminance variability of the picture displayed on a display panel as well as providing a display apparatus using this, a luminance control method and a luminance control program.

Means for Solving the Problems

The present invention is a luminance control device that controls luminance of a light source as backlight of a display panel, comprising: a picture luminance detector for detecting luminance of an input picture signal; a picture luminance storage for storing the picture luminance detected by the picture luminance detector during a fixed period of time; and, a processor for detecting variability that indicates intensity of variation of the picture luminance, based on the picture luminance and past records of the picture luminance stored in the picture luminance storage, and outputting a light source luminance control signal that designates luminance of a light source that is determined based on the picture luminance and the variability.

The invention is also characterized in that the processor reduces the light source luminance regardless of the picture luminance when the variability is higher than a first predetermined value that is set beforehand.

The invention is also characterized in that the processor reduces the light source luminance when the variability is lower than a second predetermined value that is set beforehand and when the picture luminance is higher than a first threshold.

The invention further comprises an image processor for acquiring a compensated picture signal of which picture luminance is increased so as to compensate for a lowering of light source luminance for a picture for which light source luminance is reduced, and is characterized in that the processor further reduces the light source luminance in accordance with the luminance of the compensated picture signal.

The invention further includes a synchronization processor that synchronizes an input picture signal with the light source luminance control signal by delaying the input picture signal in conformity with a delay due to a control process of the light source luminance.

The invention is also characterized in that the processor calculates a directional characteristic of the variation of the picture luminance, and increases the amount of reduction in the light source luminance when the directional characteristic of variation is on a downward trend and suppresses the amount of reduction in the light source luminance when the directional characteristic of the variation is on an upward trend.

The invention is also characterized in that the processor calculates a directional characteristic of the variation of the picture luminance, and increases the amount of reduction in the light source luminance when a progress of a directional characteristic of the variation changes from an upward trend to a downward trend.

The invention is also characterized in that the processor calculates a directional characteristic of the variation of the picture luminance, and suppresses the amount of reduction in the light source luminance when a directional characteristic of the variation progresses in an order of a downward trend, a non-directional trend and an upward trend.

The present invention is a display apparatus comprising: the luminance control device; and a display unit including a display panel, a light source disposed near the display panel and a light source controller for controlling the light source in accordance with a light source luminance control signal from the luminance control device.

The present invention is a luminance control method of controlling luminance of a light source as backlight of a display panel, comprising: a picture luminance detecting step of detecting luminance of an input picture signal; a picture luminance storing step of storing the picture luminance detected at the picture luminance detecting step for a fixed period of time; and a processing step of detecting variability that indicates intensity of variation of the picture luminance, based on the picture luminance and the past records of the picture luminance stored at the picture luminance storing step and outputting a light source luminance control signal that designates luminance of the light source that is determined based on the picture luminance and the variability.

The present invention is a luminance control program for causing a control device to execute the above luminance control method.

Advantages of the Invention

According to the present invention, light source luminance can be reduced without causing a visually significant change by analyzing the variability of picture luminance so that it is possible to increase opportunity for reducing light source luminance compared to the prior art. It is hence possible to further cut down power consumption.

In particular, in comparison with the prior art, it is possible to reduce light source luminance and hence cut down power consumption even for a picture having continuous, overall bright scenes if the variability is high.

Further, according to the present invention, it is possible to achieve a further reduction in luminance and hence cut down power consumption, by taking into account the directional characteristic of variation in addition to the light source luminance control. Moreover, by adjusting reduction in light source luminance in accordance with the progress of the directional characteristic of variation, it is possible to realize easy-to-see display while maintaining contrast without lowering picture quality.

MODES FOR CARRYING OUT THE INVENTION

Next, embodied modes of the present invention will be described with reference to the attached drawings.

In order to suppress power consumption, the present invention reduces the luminance of the light source for backlight arranged near an non-self-emitting display panel. Upon this, the picture luminance is analyzed so as to determine luminance variability, based on which the light source luminance for backlight is reduced in such a degree that the change is unlikely to be visually perceived.

As to human perception of luminance and change in luminance, the following law and studies have been generally known.

(1) The Weber-Fechner Law

The minimum change ΔS of a stimulus perceivable by human is proportional to the magnitude S of the original stimulus. Accordingly, as the luminance of the whole is higher, fine lowering of luminance is unlikely to be perceived.

$$\Delta S = kS$$

(2) De Lange's Research

Figure 1:
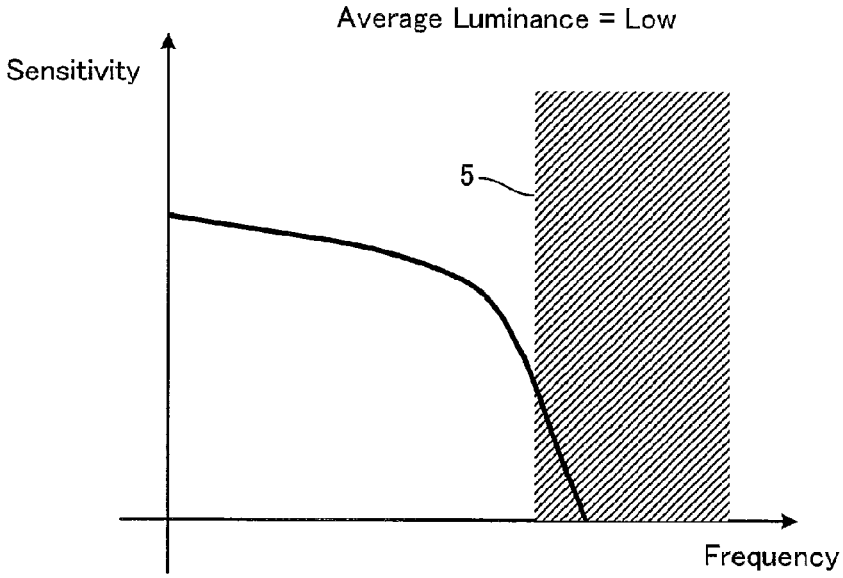
[FIG. 1] is a diagram showing the relationships between the sensitivity of perceiving change in luminance and the frequency of luminance change in the De Lange's research.
Figure 1:
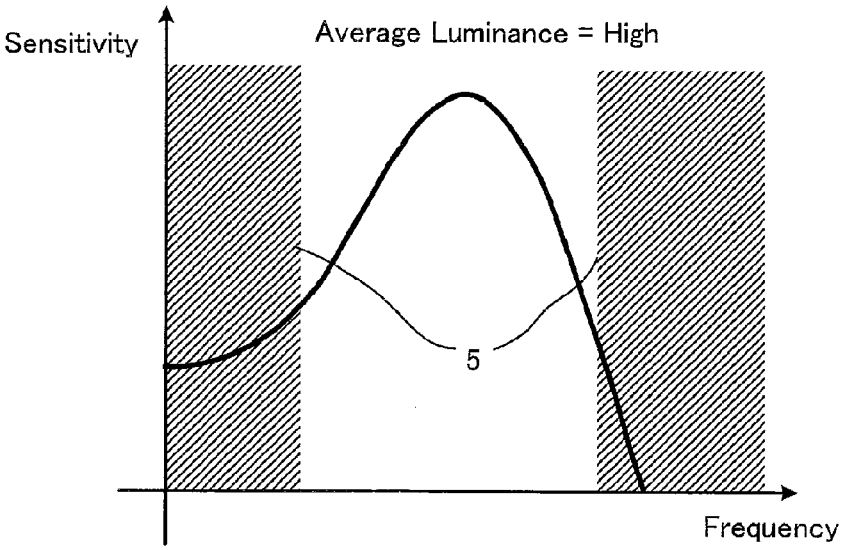

FIG. 1 shows the relationships between the sensitivity of perceiving change in luminance and the frequency of luminance change. The sensitivity of perceiving change in luminance indicates the minimum perceivable change of luminance by human. FIG. 1(*a*) shows a case where the displayed average luminance is low, and the high-frequency (extremely rapid) luminance variation is unlikely to be perceived (5: the range in which variation is unlikely to be perceived). FIG. 1(*b*) shows a case where the displayed average luminance is high, and in that case where the displayed average luminance is high, the high-frequency (extremely rapid) variation and low-frequency (extremely slow) variation are unlikely to be perceived (5: the ranges in which variation is unlikely to be perceived).

Based on the above principles, displayed images reducible in display luminance are detected to reduce the light source luminance. Next, embodiments will be described.

<The First Embodiment>

Figure 2:
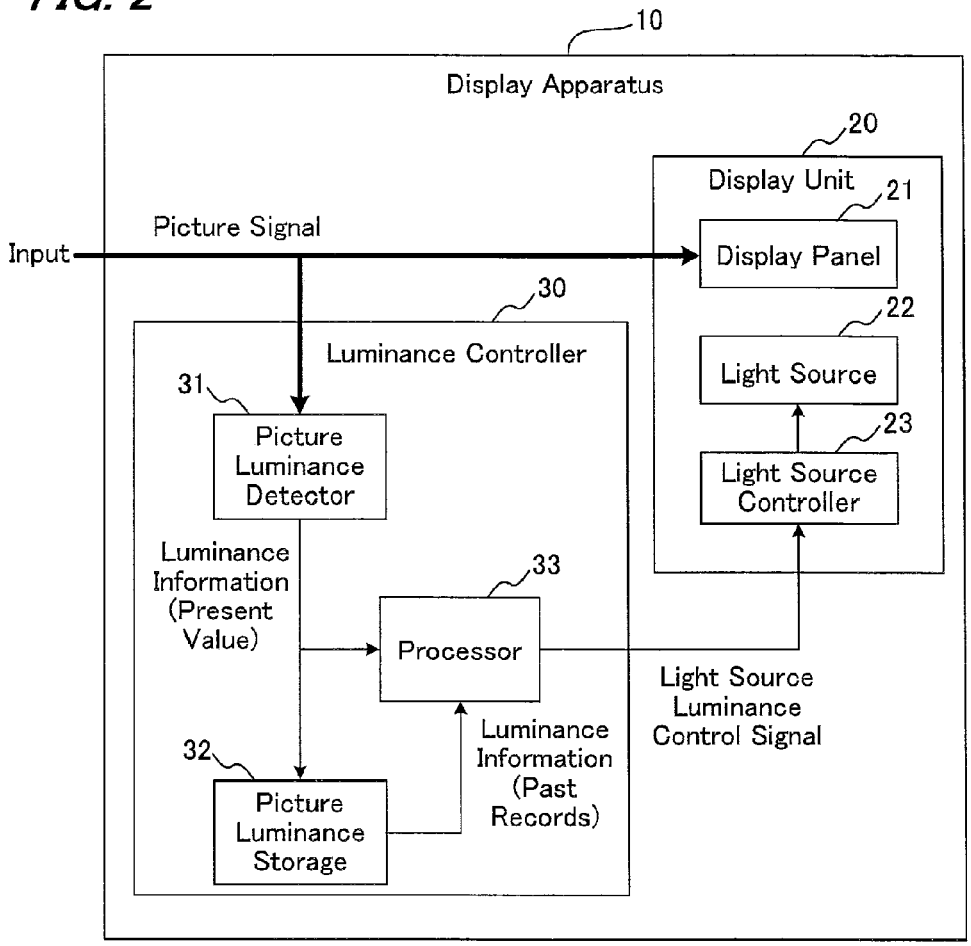
[FIG. 2] is a block diagram showing a display apparatus in the first embodiment.

FIG. 2 is a block diagram showing a display apparatus in the first embodiment.

A display apparatus 10 includes a display unit 20 and a luminance controller 30. Display unit 20 is composed of a display panel 21, a light source 22 and a light source controller 23. Luminance controller 30 is composed of a picture luminance detector 31, a picture luminance storage 32 and a processor 33.

Display panel 21 of display unit 20 is a non-self-emitting display such as liquid crystal or the like and displays a picture by modulating light from light source 22. Light source 22 arranged in the rear of display panel 21 is generally called backlight, and may use any type such as a cathode ray tube, LED or the like as long as it can adjust its brightness. Light source controller 23 controls luminance of light source 22 based on a light source luminance control signal. The light source luminance control signal may be, for example a PWM (Pulse Width Modulation) signal or the like.

Picture luminance detector 31 of luminance controller 30 acquires information such as the average luminance level (APL: Average Picture Level), luminance frequency distribution and the like, from the picture signal to calculate information (luminance information) that represents luminance of the picture every time unit. Here, the picture signal is one having a luminance component (Y component or L component) such as YUV, YCbCr, YPbPr, L*u*v*, L*a*b* or the like. For a case of a signal such as RGB or the like that does not have a luminance component, the signal should be converted into the aforementioned picture signal first and then the converted signal should be processed.

Picture luminance storage 32 of luminance controller 30 is a memory capable of accumulating the past records of luminance information in a fixed period of time (some seconds to some ten seconds). The memory uses a FIFO (First In First Out) structure in which the oldest data is deleted when new data is written in. The aforementioned fixed period is derived from the time taken for the eyes to be adapted to perceive luminance change.

Processor 33 of luminance controller 30 has processing capacity for performing an algorithm that will be detailed later. The process is roughly performed by analyzing the variability of picture luminance based on the luminance information detected by picture luminance detector 31 and the past records of luminance information stored in picture luminance storage 32 and outputting a light source luminance control signal that reduces the light source luminance in such a degree that the change is unlikely to be perceived.

Figure 3:
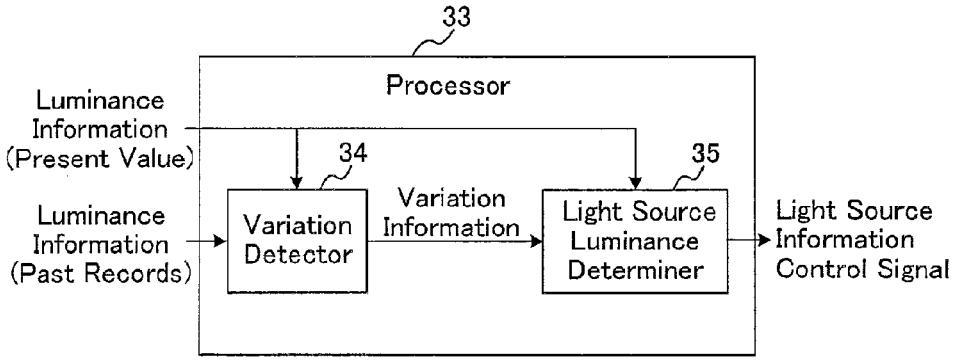
[FIG. 3] is a block diagram showing a configuration of an processor.

FIG. 3 is a block diagram showing a configuration of processor 33.

Processor 33 is configured of a variation detector 34 and a light source luminance determiner 35. Variation detector 34 performs detection of the variability of picture luminance based on the luminance information on the current picture detected by picture luminance detector 31 and the past records of the luminance information on the picture stored in picture luminance storage 32 to output the detection result as variation information. Light source luminance determiner 35 determines light source luminance based on the luminance information on the current picture detected by picture luminance detector 31 and the variation information output from variation detector 34 and outputs the determined result as a light source information control signal.

The process of determining the light source luminance in processor 33 will be described.

Variation detector 34 detects "variability" of picture luminance, i.e., how the current picture luminance has varied, based on the past records of the picture luminance information stored in picture luminance storage 32, and outputs the detected result as the variation information. That is, the variation information is information that shows whether the variability is low, moderate or high.

Here, "variability" indicates the intensity of luminance change or instability, involving the ratios of luminance change and the concept of the frequency of luminance change. Accordingly, "low variability" means that the change of the picture luminance does not occur so much is rather monotonous, or that the variation frequency is low. "High variability" means that the change of the picture luminance occurs sharply, or that the variation frequency is high. "Moderate variability" means a middle level between the two.

Figure 4:
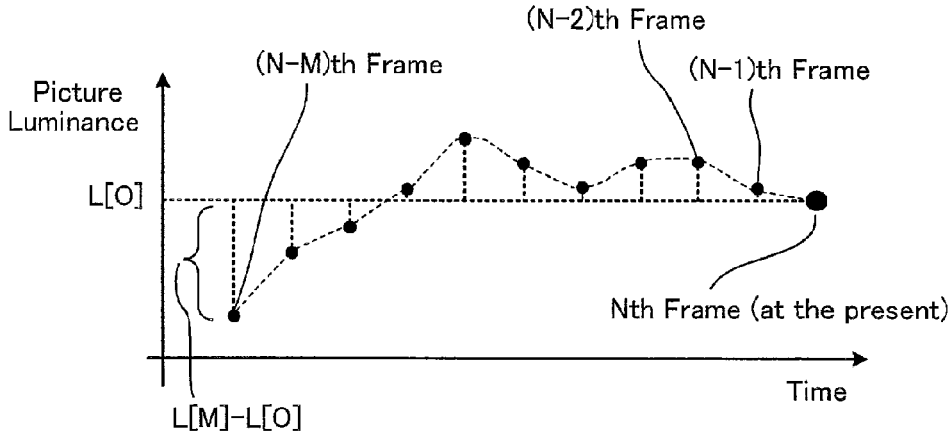
[FIG. 4] is an illustrative diagram of a variability deriving method.

As an exemplary method of derivation of the variability in variation detector 34, the summation of variations may be calculated as an index that indicates variability, based on the current picture luminance level (detected based on APL or luminance frequency distribution) and the past records of picture luminance levels. FIG. 4 is a diagram of illustrating this variability deriving method.

Time is defined based on the number of frames, and this is taken as the horizontal axis. The vertical axis shows picture luminance. The present time detected by picture luminance detector 31 is set as the Nth frame, picture luminance information on M frames previous to the Nth frame is stored in picture luminance storage 32 as the past records in the order of detection by picture luminance detector 31. Here, the frame previous to the Nth frame by i frames is named as the (N−i)th frame, and the picture luminance of that frame is named L[i].

Based on the Nth frame luminance L[0], the summation of the variations of the M frames previous to the Nth frame is determined.

To begin with, the summation of the luminance lower than the Nth frame luminance L[0] is calculated. This is the total of negative differences. Since the difference is added when a change has occurred in such a direction as to increase luminance, the total, when it is named increase summation $V_i$, is given as the following expression:

$$V_i = -\sum_{i=1}^{M} \min(L[i] - L[0], 0) \quad \text{[Math 1]}$$

Next, the summation of the luminance higher than the Nth frame luminance L[0] is determined. This is the total of positive differences. Since the difference is added when a change has occurred in such a direction as to decrease luminance, the total, when it is named decrease summation $V_d$, is given as the following expression:

$$V_d = \sum_{i=1}^{M} \max(L[i] - L[0], 0) \quad \text{[Math 2]}$$

The sum of these makes variation summation V.

$$V = V_i + V_d \quad \text{[Math 3]}$$

Based on the thus determined variation summation V, variation detector 34 determines variability. On example will be described herein below.

First, a variation reference unit should be determined beforehand. The variation reference unit can be determined by the following formula.

Variation Reference Unit=Frame Rate×Accumulation Time×Number of Gradations.

When, for example, the frame ratio is 30 FPS, the accumulation time is 10 seconds and the number of gradations is 256, the variation reference unit amounts to 76,800.

Figure 5:
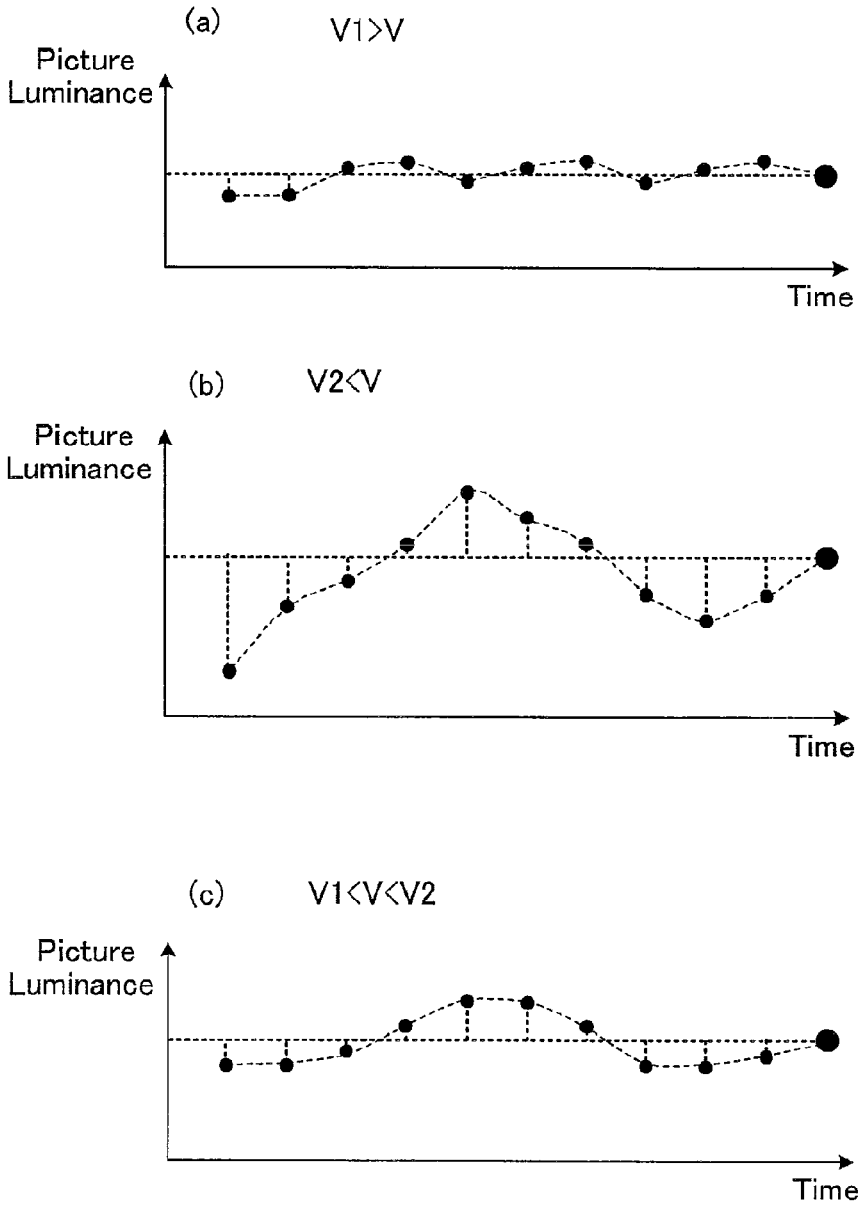
[FIG. 5] is a diagram showing the determined results on variability in different variations in picture luminance.

Here, "variability is small" is assumed to mean that summation of variations V is less than 1 to 3% of the reference unit. In this case, 2% of 76,800 ((the variation reference unit)×2%) is approximately equal to 1,500, for example. Accordingly, when the threshold V1 for determining "variability is small" is set at 1,500, it is determined that "variability is small" if the summation of variations V is less than threshold V1. FIG. 5(*a*) shows the variation in the picture luminance when "variability is small".

"Variability is large" is assumed to mean that summation of variations V is equal to or greater than 10 to 15% of the reference unit. In this case, 13% of 76,800 ((the variation reference unit)×13%) is approximately equal to 10,000, for example. Accordingly, when the threshold V2 for determining "variability is large" is set at 10,000, it is determined that "variability is large" if the summation of variations V is equal to or greater than threshold V2. FIG. 5(*b*) shows the variation in picture luminance when "variability is large".

Further, a condition between "small variability" and "large variability" is referred to as "variability is moderate". Accordingly, the summation of variations V falls in the range between the above thresholds V1 and V2 when "variability is moderate". FIG. 5(*c*) shows the variation in picture luminance when "variability is moderate".

Though in the present embodiment, the variability is determined based on the past records of picture luminance, the invention is not limited to this. For example, it is possible to decide variability by determining (1) the dispersion of the past record values of picture luminance, (2) the standard deviation of the past record values of picture luminance, (3) changing rate by taking a differentiation (difference) as to the past record values of picture luminance, (4) the frequency components by transforming the past record values of picture luminance into the frequency domain representation by DFT, DCT or other methods, or the like.

Light source luminance determiner 35, based on variation information output from variation detector 34, determines the amount of reduction of light source luminance and outputs a light source luminance control signal. Table 1 shows a relationship between the variability of picture luminance and the amount of reduction of light source luminance. This is based on the aforementioned De Lange's research.

TABLE 1

| | Luminance | |
|---|---|---|
| Variability | Low | High |
| Low | Small Reduction | Large Reduction |
| Middle | Small Reduction | Small Reduction |
| High | Large Reduction | Large Reduction |

Now, one example of a high and low decision as to luminance made by light source luminance determiner 35 based on the current luminance information in Table 1 will be described.

First, for example, the values of luminance less than 20% of the representable range are defined as low luminance. Accordingly, for 8 bits=256 gradations, 256×0.2 is approximately equal to 50, so that a luminance value less than threshold L1=50 is defined as low luminance.

On the other hand, for example, the values of luminance equal to or greater than about 60% of the representable range are defined as high luminance. Accordingly, for 8 bits=256 gradations, 256×0.6 is approximately equal to 150, so that a luminance value equal to or greater than threshold L2=150 is defined as high luminance.

In this way, light source luminance determiner 35 determines the following light source luminance based on the current picture luminance and variability.

When magnification α on the light source luminance is defined as a function of the current picture luminance L and summation of variations V, α is written as:

$$\alpha=f(L, V).$$

Here, factor α to be multiplied on the light source luminance is a figure equal to or lower than 1.

Figure 6:
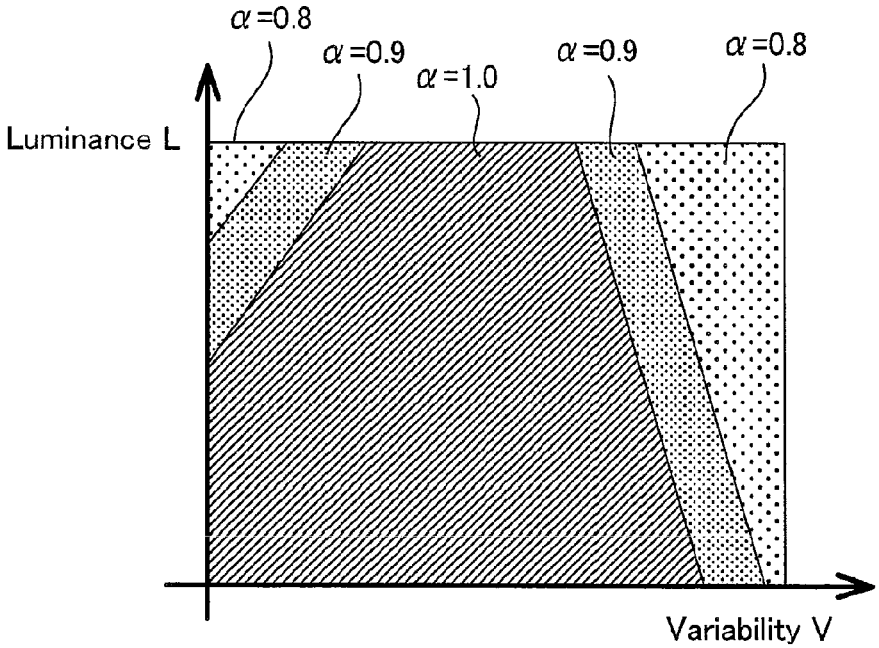
[FIG. 6] is a chart showing one example of a function that determines a light source luminance magnification a based on the current picture luminance L and the summation of variations V.

FIG. 6 is a chart showing one example of the function that determines the light source luminance magnification abased on the current picture luminance L and the summation of variations V. In this function, when picture luminance L is fixed, there holds a relationship that the magnification α on the light source luminance becomes smaller the more distant from the moderate range the variability V is. When variability V is fixed, there holds a relationship that the magnification α on the light source luminance becomes smaller the greater the picture luminance L is.

Alternatively, it is also possible to determine the magnification α on the light source luminance based on the following matrix (lookup table) of the current picture luminance L and summation of variations V as shown in Table 2.

TABLE 2

| | Variability | | |
|---|---|---|---|
| Luminance | $V < V_1$ | $V_1 \leq V < V_2$ | $V > V_2$ |
| $L > L_2$ | 0.8 | 0.9 | 0.8 |
| $L_1 \leq L < L_2$ | 0.9 | 1.0 | 0.8 |
| $L < L_1$ | 1.0 | 1.0 | 0.9 |

Though control herein is made with the variability and picture luminance each divided into three ranges, the way of classification is not limited to this. Control may be performed by dividing variability and picture luminance more minutely. Also, the magnification α on the light source luminance should not be limited to the values in the drawing and Table 2.

Figure 7:
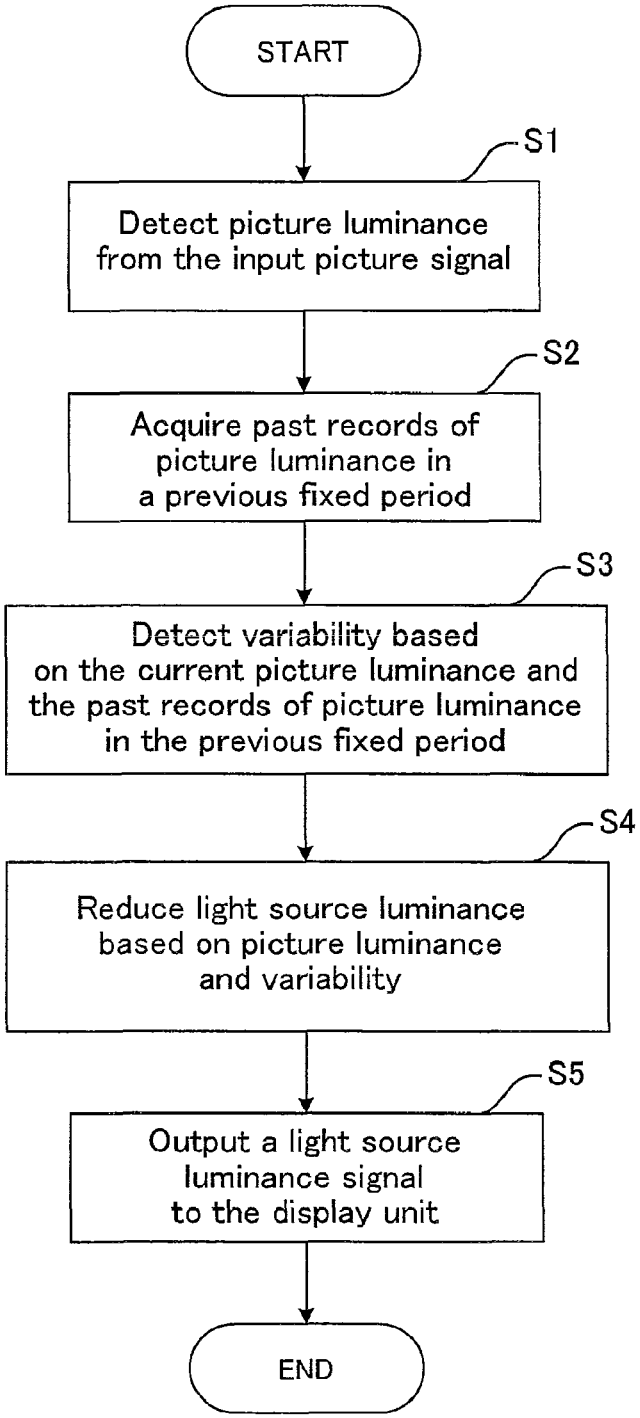
[FIG. 7] is a flow chart showing a control processing sequence of a luminance controller in the first embodiment.

FIG. 7 is a flow chart showing a control processing sequence of luminance controller 30 in the first embodiment.

Picture luminance detector 31 detects picture luminance from an input picture signal and outputs the luminance information to variation detector 34 and light source luminance determiner 35 of processor 33, and picture luminance storage 32 (Step S1). Picture luminance storage 32 stores the luminance information and holds the luminance information for a fixed period as the past record of picture luminance. Variation detector 34 of processor 33 acquires the past records of picture luminance in the previous fixed period, stored in picture luminance storage 32 (Step S2). Variation detector 34 of processor 33 detects variability based on the luminance information output from picture luminance detector 31 and the past records of picture luminance for the previous fixed period, stored in picture luminance storage 32 (Step S3). The method of deriving variability is as described already. Light source luminance determiner 35 of processor 33 reduces the light source luminance using the variation information (variability) output from variation detector 34 and the current picture luminance information (picture luminance) detected by picture luminance detector 31 (Step S4). Herein, the condition for reduction and the amount of reduction based on the variability and the current picture luminance are as described before. Light source luminance determiner 35 determines light source luminance and outputs a light source luminance control signal to light source controller 23 of display unit 20 (Step S5).

Figure 8:
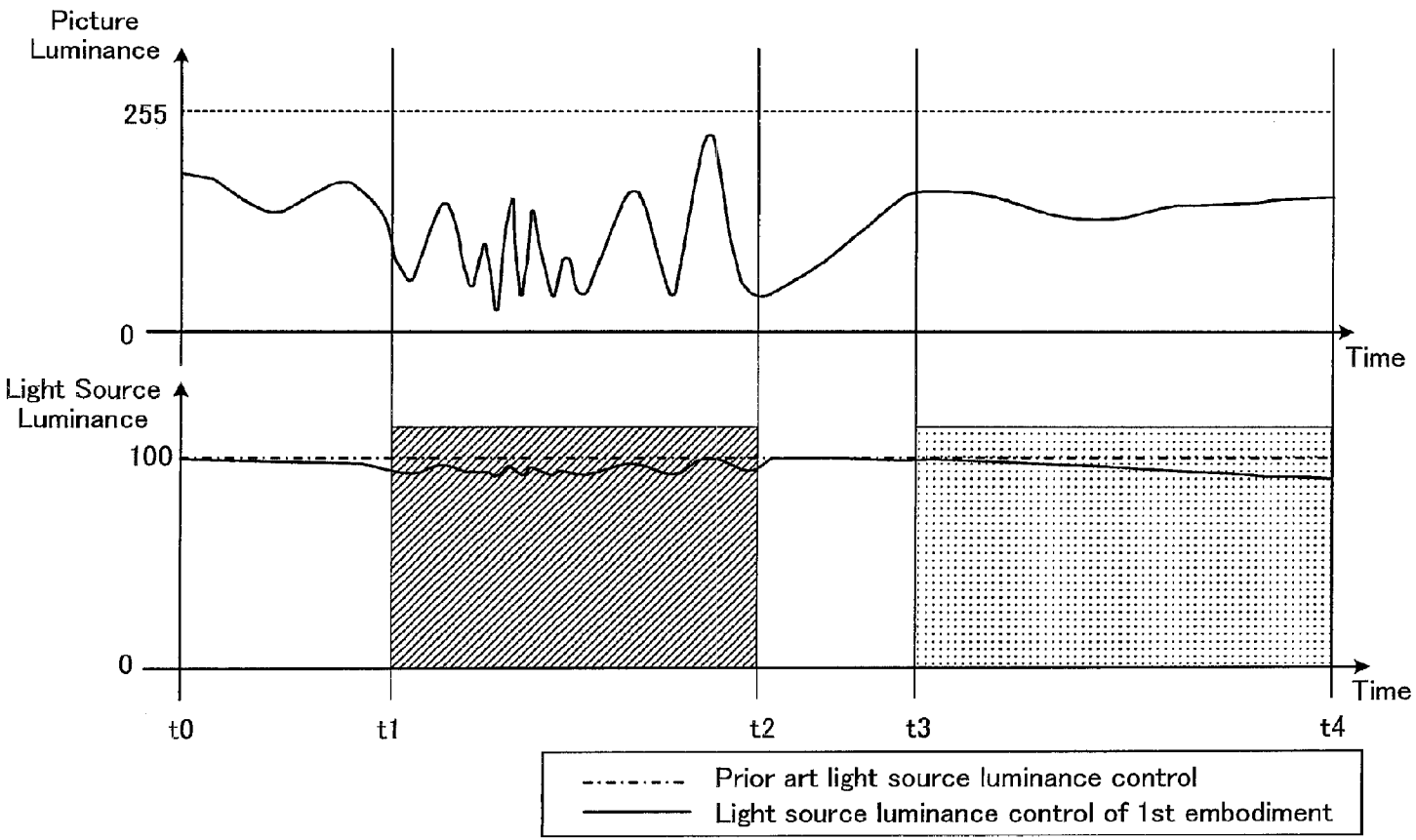
[FIG. 8] is a chart comparing the light source luminance control of a display apparatus of the first embodiment with the light source luminance control of a conventional display apparatus.

FIG. 8 is a chart comparing the light source luminance control of the display apparatus of the first embodiment with the light source luminance control of a conventional display apparatus. The conventional display apparatus is one that has no luminance controller 30 hence does not perform light source luminance control.

As shown in FIG. 8, picture luminance presents a high variability (varies sharply and presents high frequencies) from time t1 to t2, presents a low variability (varies little and presents low frequencies) from time t3 to t4, and presents a moderate variability from time t0 to t1 and from t2 to t3.

Since, in the conventional display apparatus, no light source luminance control is performed, the light source always offers fixed luminance regardless of the variability of picture luminance. In FIG. 8, the light source luminance of the conventional display apparatus is shown with a dashed-and-dotted line and this is assumed to be 100. On the other hand, display apparatus 10 of the first embodiment controls light source luminance in accordance with the variability of picture luminance, for example, following the lookup table as shown in Table 2. That is, because the variability is moderate from time t0 to t1 and from t2 to t3, light source luminance is reduced within an unperceivable degree when picture luminance is high. On the other hand, from time t1 to t2, since the variability is so high that reduction in picture luminance is unlikely to be perceived regardless of the picture luminance level, the light source luminance is reduced within an unperceivable degree. From time t3 to t4, the variability is low so that the light source luminance is gradually reduced when picture luminance is high or moderate.

In this way, the present embodiment reduces light source luminance in accordance with the variability of picture luminance and increases opportunity for reducing light source luminance compared to the prior art, it is hence possible to sharply reduce power consumption compared to the prior art.

<The Second Embodiment>

Figure 9:
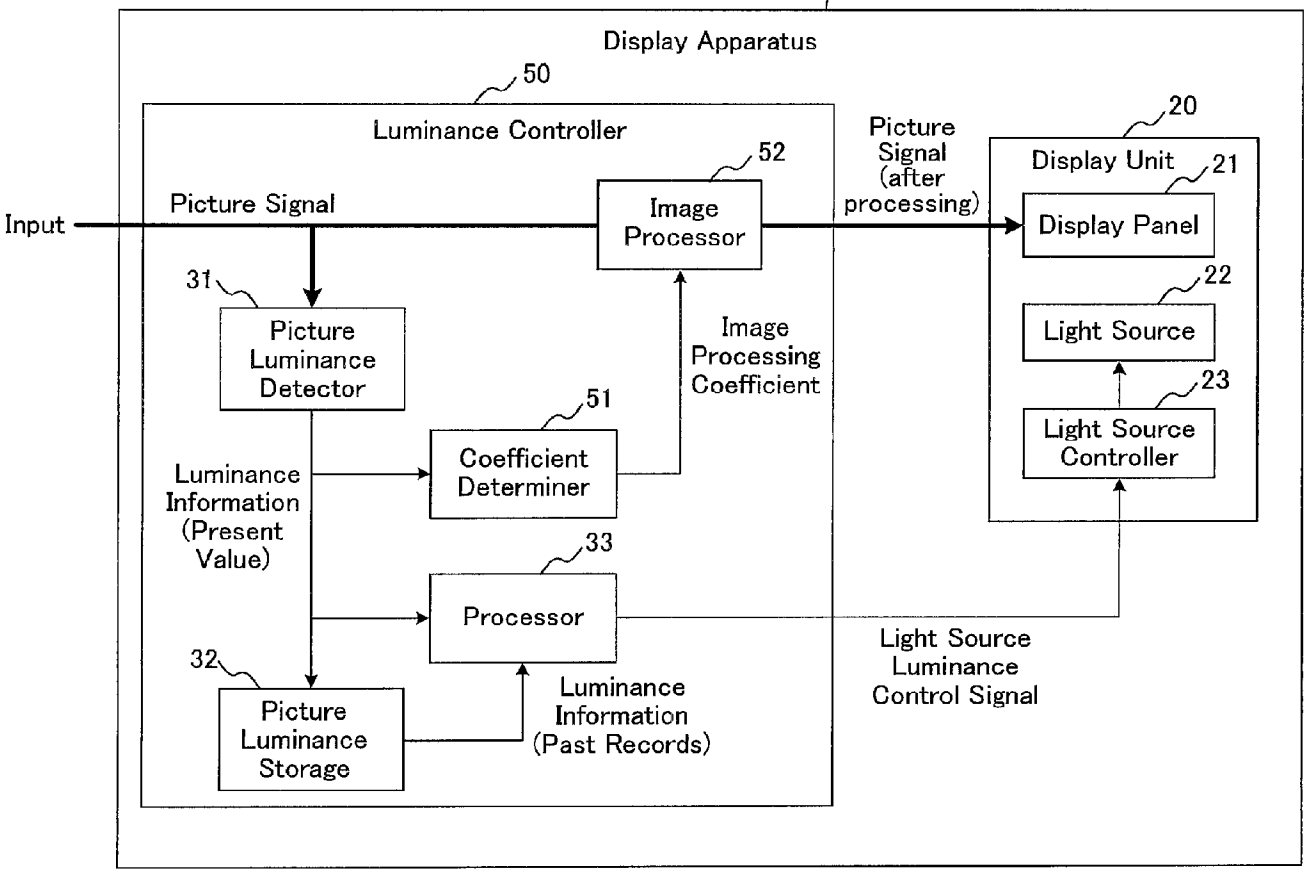
[FIG. 9] is a block diagram showing a display apparatus in the second embodiment.

FIG. 9 is a block diagram showing a display apparatus in the second embodiment.

A display apparatus 40 includes a display unit 20 and a luminance controller 50. Display unit 20 is composed of a display panel 21, a light source 22 and a light source controller 23, similarly to the first embodiment. Luminance controller 50 includes a coefficient determiner 51 and an image processor 52 in addition to picture luminance detector 31, picture luminance storage 32 and processor 33 of the first embodiment.

In the present embodiment, while the light source luminance is reduced, an image process of compensating the picture signal for the lowering of light source luminance is added so as to make the change in luminance more inconspicuous. That is, the picture for which light source luminance should be reduced, is subjected to an image process for enhancing its picture luminance so that the reduction and the enhancement offset each other, whereby reduction in luminance is made unlikely to be perceived. Accordingly, it is possible to make a further reduction in light source luminance.

First, coefficient determiner 51 calculates a coefficient for the image process of compensating for the lowering of light source luminance, from picture luminance (the present value). When β represents the image processing coefficient, $L_{normal}$ the original light source luminance, $L_{reduce}$ the reduced light source luminance, and γ the γ value of the liquid crystal panel, the following equation holds:

$$\beta = \left(\frac{L_{normal}}{L_{reduce}}\right)^{1/\gamma} \quad \text{[Math 4]}$$

Based on the image processing coefficient β determined at coefficient determiner 51, image processor 52 performs an image process of compensating for the lowering of light source luminance to output a compensated picture signal. When $Y_{in}$ represents the picture signal input to image processor 52 and $Y_{out}$ represents the compensated picture signal output from image processor 52, the following equation holds.

$$Y_{out}=\beta Y_{in}$$

Here, image processing coefficient β is a figure equal to or greater than 1.

Figure 10:
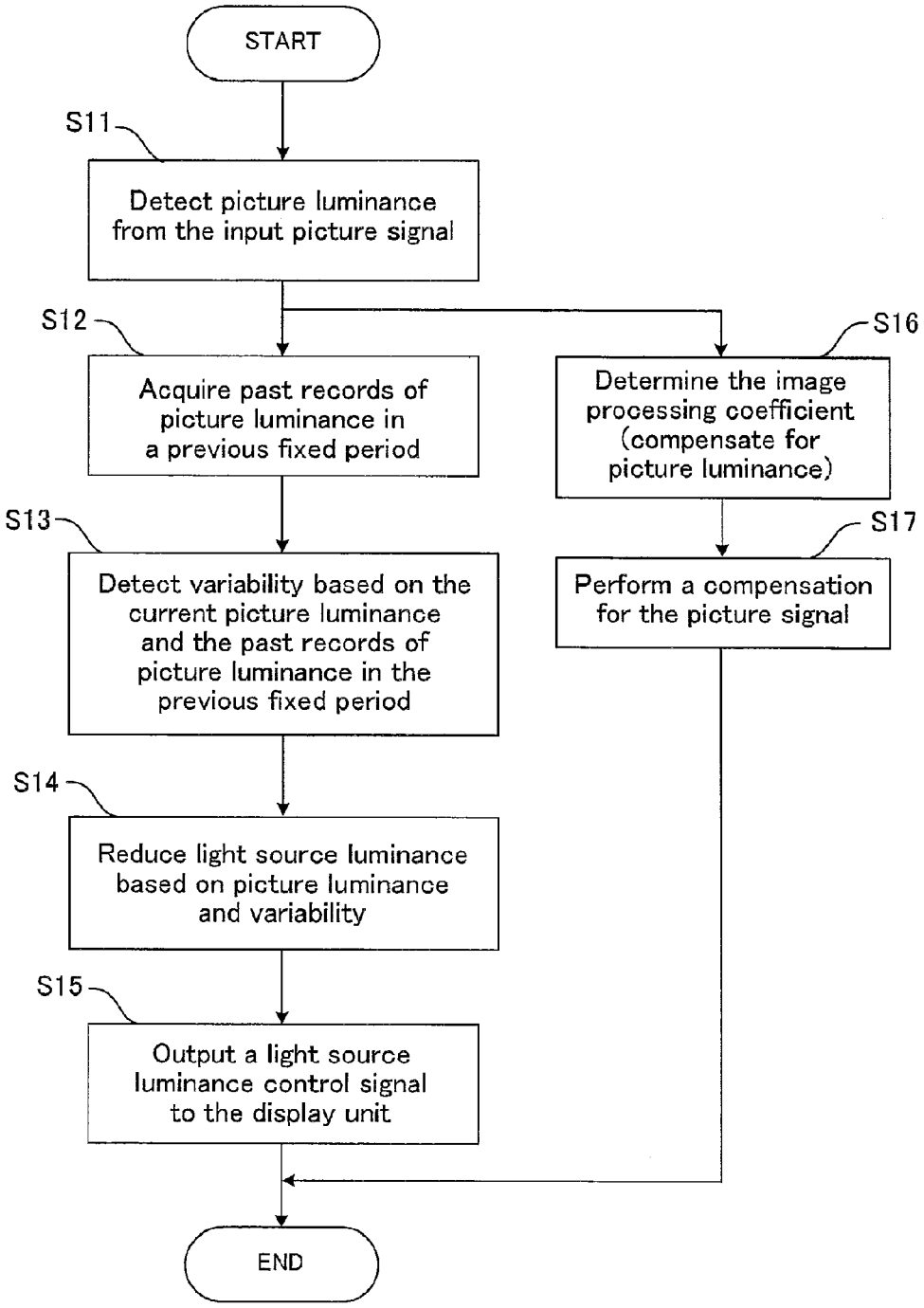
[FIG. 10] is a flow chart showing a control processing sequence of a luminance controller 50 in the second embodiment.

FIG. 10 is a flow chart showing a control processing sequence of luminance controller 50 in the second embodiment.

The process from Steps S11 to S15 are the same as Steps S1 to S5 in FIG. 7 so that description is omitted. Coefficient determiner 51 determines image processing coefficient β as stated above, based on the luminance information output from picture luminance detector 31 (Step S16). Image processor 52 performs a compensation process on the picture signal in accordance with the determined image processing coefficient β and outputs the resultant to display panel 21 of display unit 20 (Step S17).

Figure 11:
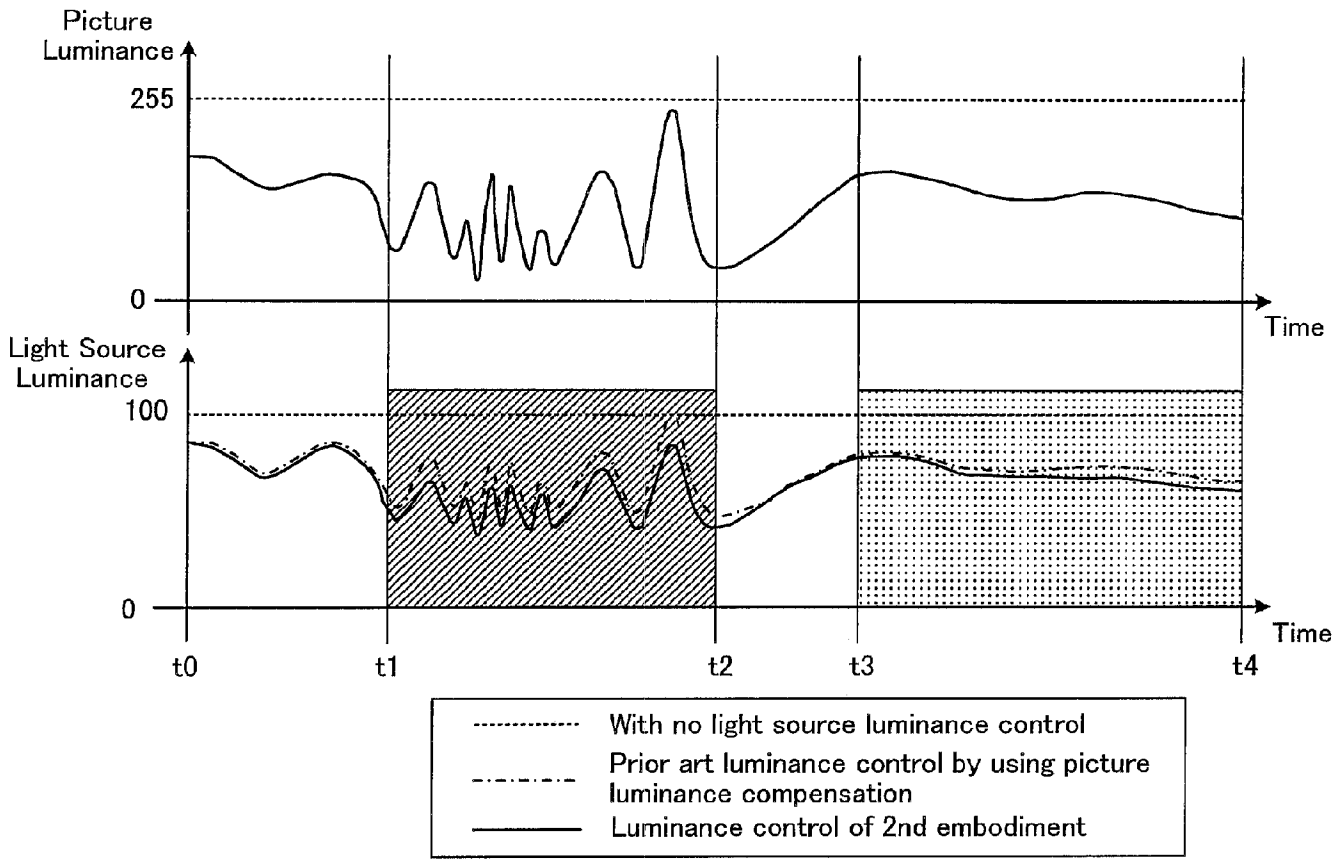
[FIG. 11] is a chart for making comparison between the light source luminance control (with no light source control) of a conventional display apparatus, the light source luminance control of a display apparatus for performing conventional luminance compensation, and the light source luminance control of a display apparatus of the second embodiment.

FIG. 11 is a chart for making comparison between the light source luminance control (with no light source control) of a conventional display apparatus, the light source luminance control of a display apparatus for performing conventional luminance compensation, and the light source luminance control of a display apparatus of the second embodiment. Herein, the conventional display apparatus performing conventional luminance compensation is one that has no picture luminance storage 32 in the second embodiment, hence the processor does not perform light source luminance control in accordance with variability. Similarly to FIG. 8, picture luminance presents a high variability (varies sharply and presents high frequencies) from time t1 to t2, presents a low variability (varies little and presents low frequencies) from time t3 to t4, and presents a moderate variability from time t0 to t1 and from t2 to t3.

In FIG. 11, the light source luminance of the conventional display apparatus (having no luminance control) is shown with a dashed line, the light source luminance of the conventional display apparatus performing an image process for picture luminance compensation is shown with a dashed-and-dotted line, and the light source luminance of the display apparatus of the second embodiment is shown by a solid line. The light source luminance of the display apparatus involving the image process for picture luminance compensation only is controlled simply in proportion to picture luminance. However, since, in the second embodiment, the image process of compensating for the lowering of light source luminance is performed, even a further reduction is unlikely to be perceived. Accordingly, it is possible to achieve a further reduction in power consumption.

<The Third Embodiment>

Figure 12:
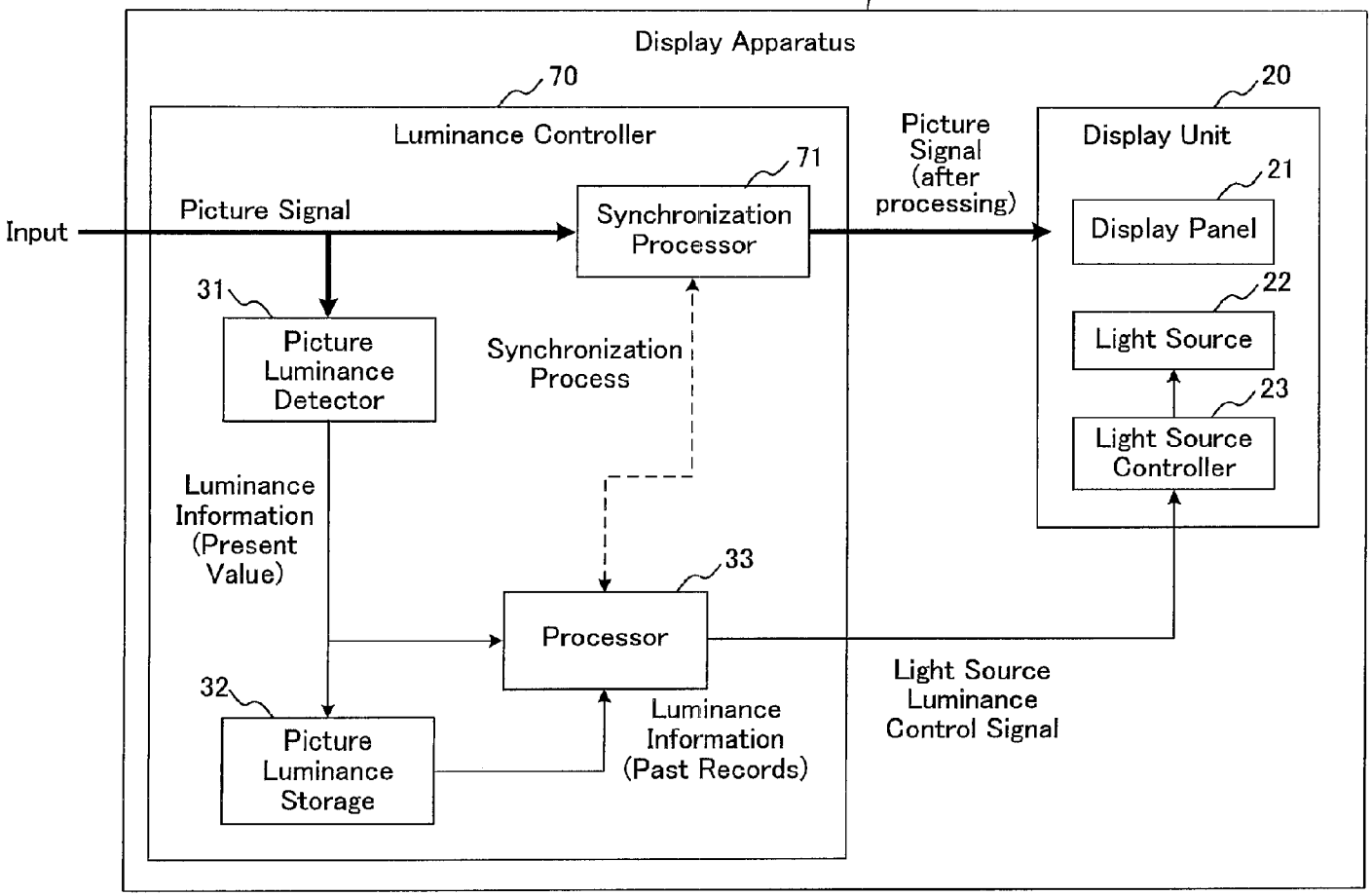
[FIG. 12] is a block diagram showing a display apparatus in the third embodiment.

FIG. 12 is a block diagram showing a display apparatus in the third embodiment.

A display apparatus 60 includes a display unit 20 and a luminance controller 70. Display unit 20 is composed of a display panel 21, a light source 22 and a light source controller 23, similarly to the first embodiment. Luminance controller 70 includes a synchronization processor 71 in addition to picture luminance detector 31, picture luminance storage 32 and processor 33 of the first embodiment.

Figure 13:
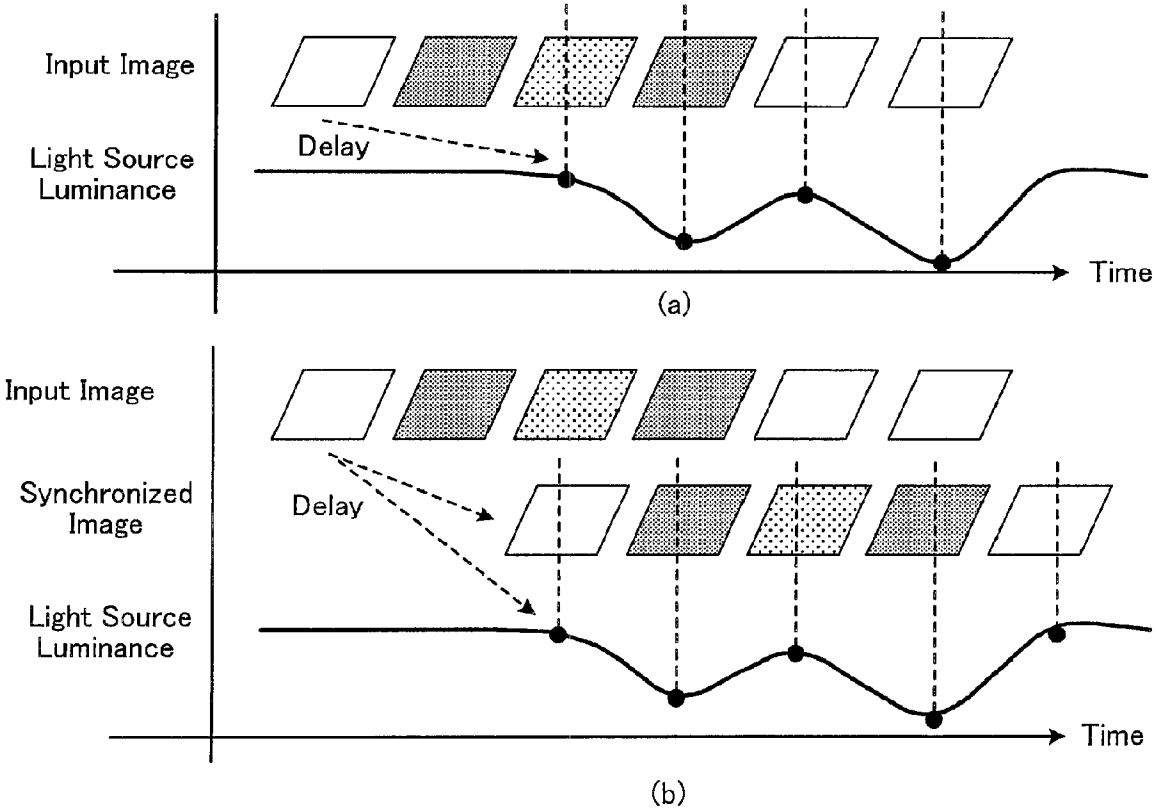
[FIG. 13] is a diagram for illustrating delaying process on input images in a light source luminance control process.

As shown in FIG. 13(*a*), from the inherent properties of the algorithm that accumulates and uses past record information, the luminance control of the light source involves some delay relative to the picture input. In order to alleviate this influence, the present embodiment is added, as shown in FIG. 13(*b*), with a synchronization processor (frame buffer) 71 that gives a delay to the picture signal so as to adjust the output timing of the signal to that of the light source luminance.

Figure 14:
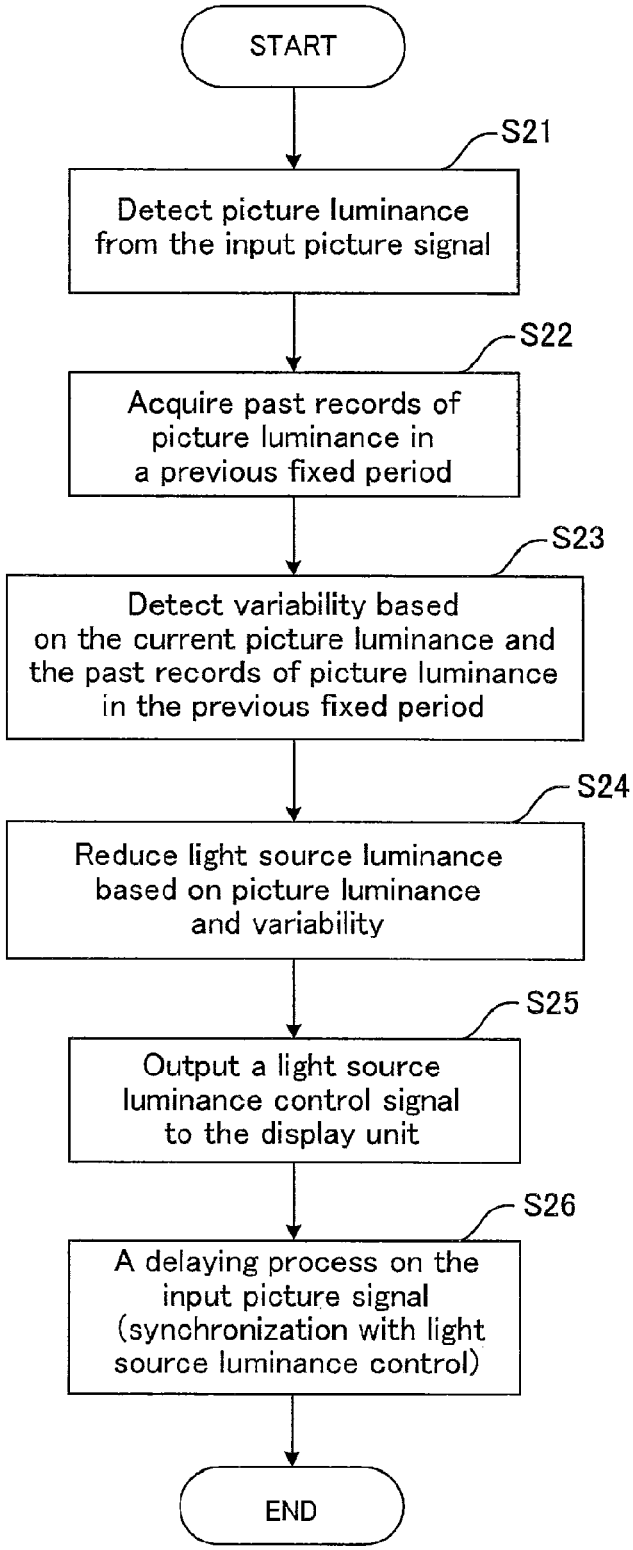
[FIG. 14] is a flow chart showing a control processing sequence of a luminance controller in the third embodiment.

FIG. 14 is a flow chart showing a control processing sequence of luminance controller 70 in the third embodiment.

The process from Steps S21 to S25 are the same as Steps S1 to S5 in FIG. 7 so that description is omitted. Synchronization processor 71 delays the picture signal so that it synchronizes with the light source luminance control signal at Step S25 (Step S26).

In this way, it is possible to prevent the lowering of light source luminance from being perceived due to a time lag between the light source luminance control and the input picture signal.

Though the third embodiment has a configuration in which synchronization processor 71 is added to luminance controller 30 of the first embodiment, synchronization processor 71 may be added to luminance controller 50 of the second embodiment. In this case, synchronization processor 71 is disposed downstream of image processor 52 so as to perform a synchronization process on the picture for which the compensation process of the picture luminance signal has been performed.

<The Fourth Embodiment>

The display apparatus of the fourth embodiment has the same configuration as FIG. 2 but uses a different method of light source luminance control in processor 33. In the fourth embodiment, variation detector 34 calculates the directional characteristic of the change in picture luminance in addition to the picture luminance variability, which are used to perform light source luminance control by light source luminance determiner 35. The directional characteristic is determined by calculating a difference D between an older value (e.g., the oldest past record value) of the past records of luminance and a newer value (e.g., the present value) of the past records of luminance.

Figure 15:
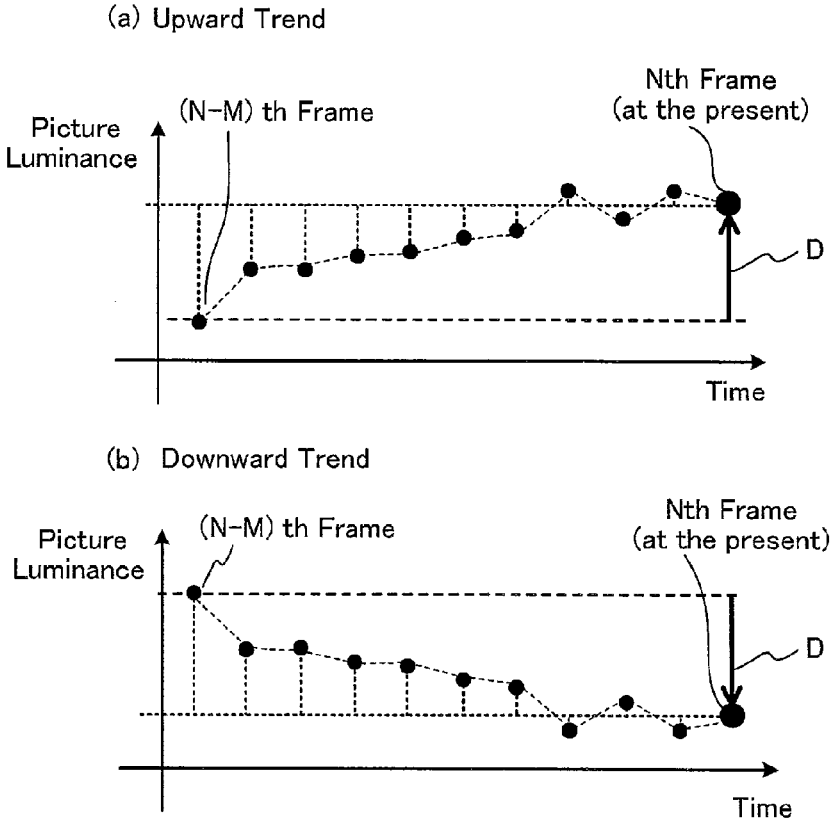
[FIG. 15] is a diagram showing the directional characteristic of picture luminance variation based on the oldest past record value and the present value.

FIG. 15 is a diagram showing the directional characteristic of picture luminance variation based on the oldest past record value and the present value. FIG. 15(*a*) shows that the direction of variation of the past luminance records has the upward trend toward the present frame. FIG. 15(*b*) shows that the direction of variation of the past luminance records has the downward trend toward the present frame. The directional characteristic is determined based on whether a differential value D in the drawing is positive or negative. That is, if the differential value given by Differential value $D$=the present value−the oldest past record value, is positive, the directional characteristic is regarded as being on the upward trend as shown in FIG. 15(*a*). If the differential value D is negative, the directional characteristic is regarded as being on the downward trend as shown in FIG. 15(*b*). Though in this case the varying direction is calculated in a markedly simple manner, a more strict determination can be made as follows.

The condition for determining that picture luminance is on the upward trend as in FIG. 15(*a*) is that increase summation $V_i$>> decrease summation $V_d$ and luminance value L[0]>> luminance value L[M]. That is, the increase summation (total of negative differences) $V_i$ is extremely greater than the decrease summation (total of positive differences) $V_d$ and the luminance value L[M] of the (N−M) th frame is extremely smaller than the luminance value L[0] of the current Nth frame.

On the other hand, the condition for determining that picture luminance is on the down trend as in FIG. 15(*b*) is that increase summation $V_i$<< decrease summation $V_d$ and luminance value L[0]<< luminance value L[M]. That is, the increase summation (total of negative differences) $V_i$ is extremely smaller than the decrease summation (total of positive differences) $V_d$ and the luminance value L[M] of the (N−M) th frame is extremely higher than the luminance value L[0] of the current Nth frame.

In the above way, the directional characteristic of variation is determined as "upward tend" or "downward trend", based on the above conditions. Others are all regarded as "non-directional trend".

Light source luminance determiner 35 performs light source luminance control as follows, based on the above directional characteristics of picture luminance variation.

According to the aforementioned Weber-Fechner law, the higher the original picture luminance, the more unlikely to be conscious a change in luminance is. Accordingly, in a case of the downward trend, the luminance value L[M] of (N−MN) frame is high so that change in luminance is unlikely to be conscious, hence the amount of reduction is increased than the cases of the first and second embodiments. On the other hand, in a case of the upward trend, the luminance value L [M] of (N−MN) frame is low so that change in luminance is likely to be conscious hence the amount of reduction is suppressed. Table 3 shows one example of this light source luminance control.

TABLE 3

| | Downward Trend | Non-directional Trend | Upward Trend |
|---|---|---|---|
| Low Variability | Increase Reduction | Unchanged | Suppress Reduction |
| Moderate | Unchanged | Unchanged | Unchanged |
| High Variability | Increase Reduction | Unchanged | Suppress Reduction |

Figure 16:
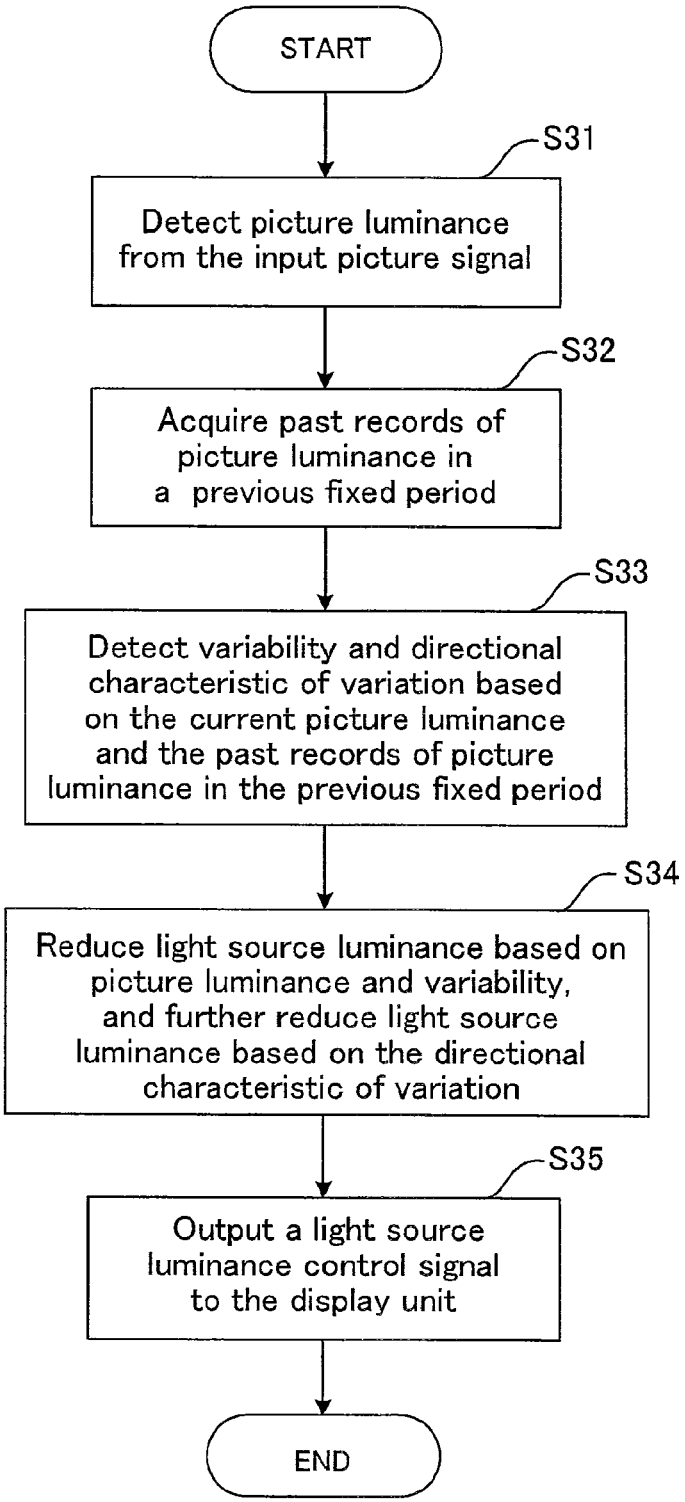
[FIG. 16] is a flow chart showing a control processing sequence of a luminance controller 30 in the fourth embodiment.

FIG. 16 is a flow chart showing a control processing sequence of luminance controller 30 in the fourth embodiment.

Picture luminance detector 31 detects picture luminance from an input picture signal and outputs luminance information to variation detector 34 and light source luminance determiner 35 of processor 33 and picture luminance storage 32

(Step S31). Picture luminance storage 32 stores the luminance information and holds the luminance information for a fixed period as past records of picture luminance. Variation detector 34 of processor 33 acquires the past records of picture luminance for the previous fixed period, stored in picture luminance storage 32 (Step S32). Variation detector 34 of processor 33 detects variability and the directional characteristic of variation based on the luminance information output from picture luminance detector 31 and the past records of picture luminance for the previous fixed period, stored in picture luminance storage 32 (Step S33). The method of deriving variability is as described already in the first embodiment. The method of deriving the directional characteristic of variation is described above. Light source luminance determiner 35 of processor 33 reduces light source luminance using the variation information (variability) output from variation detector 34 and the current picture luminance information (picture luminance) detected by picture luminance detector 31. Further, light source luminance is further reduced based on the variability and the directional characteristic of variation as shown in Table 3 (Step S34). Light source luminance determiner 35 determines light source luminance and outputs a light source luminance control signal to light source controller 23 of display unit 20 (Step S35).

In this way, it is possible to cut down power consumption by further reducing light source luminance based on the directional characteristic of variation.

<The Fifth Embodiment>

The fifth embodiment will be further described as another example of luminance control performed by light source luminance determiner 35, based on the directional characteristic of luminance variation.

Figure 17:
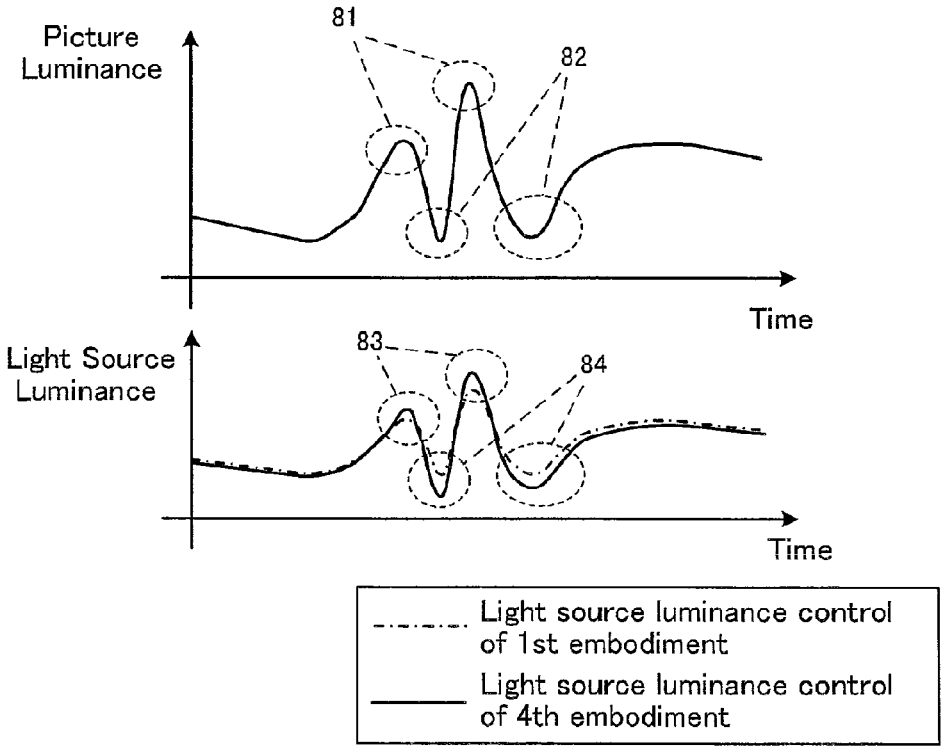
[FIG. 17] is a diagram illustrating light source luminance control depending on the progress of the directional characteristic of picture luminance variation.

FIG. 17 is a diagram illustrating light source luminance control depending on the progress of the directional characteristic of picture luminance variation.

Light source luminance determiner 35 switches control depending on the progress of the directional characteristic. That is, when the directional characteristic progresses in the order of "upward trend->non-directional trend->downward trend" (81 in FIG. 17), the variation can be estimated as a peak of high luminance (the crest in FIG. 17) so that the amount of reduction is suppressed in order to maintain the contrast (83 in FIG. 17). On the other hand, when the directional characteristic progresses in the order of "downward trend-> non-directional trend-> upward trend" (82 in FIG. 17), the variation can be estimated as a peak of low luminance (the trough in FIG. 17) so that the amount of reduction is increased in order to maintain the contrast (84 in FIG. 17).

Figure 18:
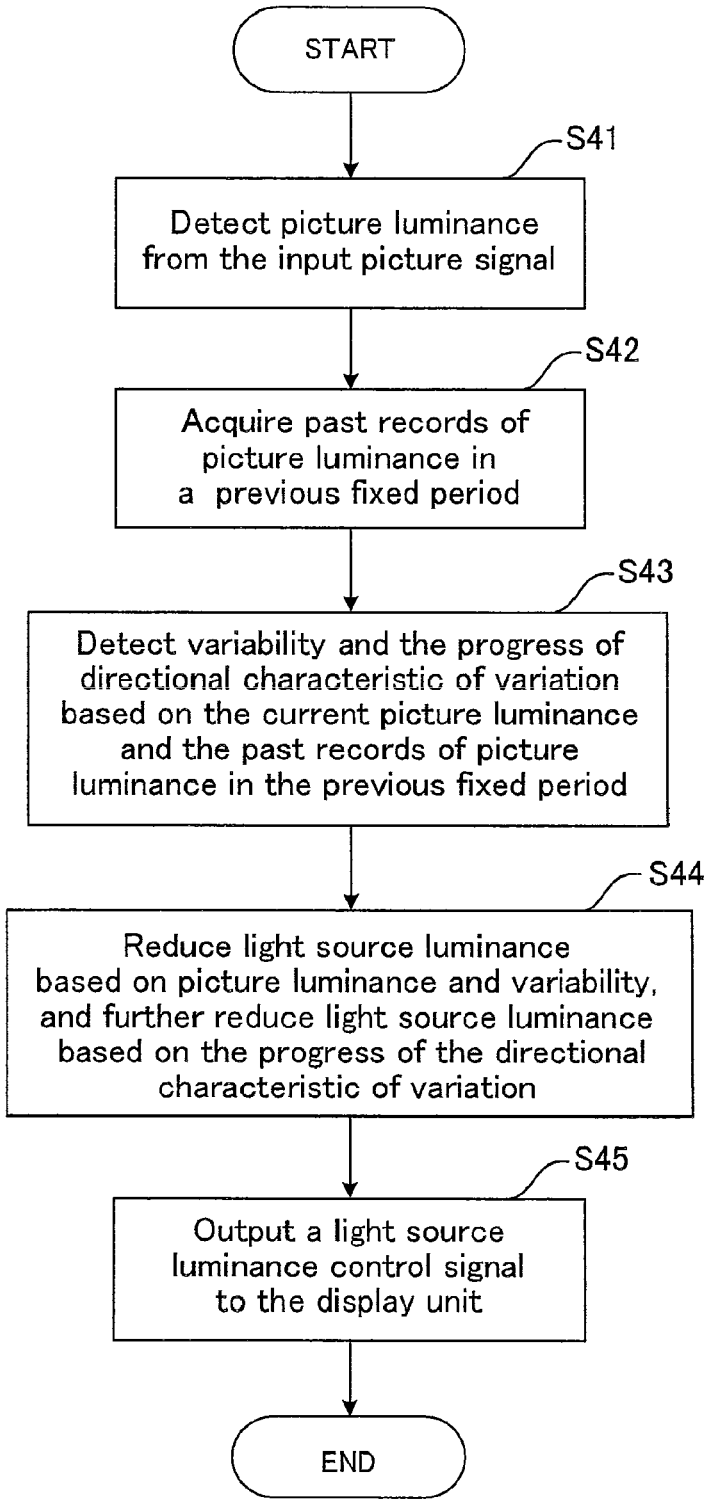
[FIG. 18] is a flow chart showing a control processing sequence of a luminance controller in the fifth embodiment.
Figure 19:
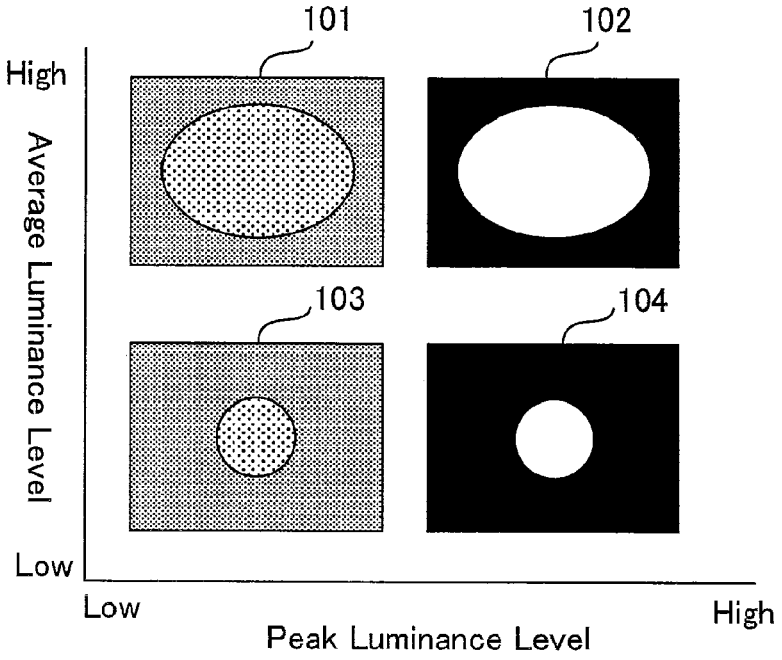
[FIG. 19] is a diagram showing four displayed image examples different in average luminance level and peak luminance level in conventional luminance control.

FIG. 18 is a flow chart showing a control processing sequence of luminance controller 30 in the fifth embodiment.

Picture luminance detector 31 detects picture luminance from the input picture signal and outputs luminance information to variation detector 34 and light source luminance determiner 35 of processor 33 and picture luminance storage 32 (Step S41). Picture luminance storage 32 stores the luminance information and holds the luminance information for a fixed period as past records of picture luminance. Variation detector 34 of processor 33 acquires the past records of picture luminance for the previous fixed period, stored in picture luminance storage 32 (Step S42). Variation detector 34 of processor 33 detects the progress of variability and the directional characteristic of variation based on the luminance information output from picture luminance detector 31 and the past records of picture luminance for the previous fixed period, stored in picture luminance storage 32 (Step S43). The method of deriving variability is as described already in the first embodiment. The method of deriving the progress of the directional characteristic of variation is described above. Light source luminance determiner 35 of processor 33 reduces the light source luminance using the variation information (variability) output from variation detector 34 and the current picture luminance information (picture luminance) detected by picture luminance detector 31. Further, based on the variability and the progress of the directional characteristic of variation, the light source luminance is adjusted in order to maintain contrast (Step S44). Light source luminance determiner 35 determines light source luminance and outputs a light source luminance control signal to light source controller 23 of display unit 20 (Step S45).

Thus, light source luminance is adjusted based on the progress of the directional characteristic of variation, so that it is possible to provide a easy-to-see, high-quality image with its contrast maintained Here, the process of each component of luminance controller 30 may be provided in hardware by using processors, logical circuits etc., or may be executed by a processor that has read programs.

Description of Reference Numerals

10 display apparatus
20 display unit
21 display panel
22 light source
23 light source controller
30 luminance controller
31 picture luminance detector
32 picture luminance storage
33 processor
34 variation detector
35 light source luminance determiner
40 display apparatus
50 luminance controller
51 coefficient determiner
52 image processor
60 display apparatus
70 luminance controller
71 synchronization processor

The invention claimed is:

1. A luminance control device that controls luminance of a light source as backlight of a display panel, comprising:

a picture luminance detector for detecting luminance of an input picture signal;

a picture luminance storage for storing a plurality of luminance detected before the luminance of the picture signal detected by the picture luminance detector; and, a processor that detects variability that indicates intensity of variation of the luminance of the picture signal based on the plurality of luminance stored in the picture luminance storage and controls luminance of a light source based on the luminance of the picture signal detected by the picture luminance detector and the variability, wherein the processor calculates a directional characteristic of the variation of the picture luminance, and increases the amount of reduction in the light source luminance when the directional characteristic of the variation is on a downward trend and suppresses the amount of reduction in the light source luminance when the directional characteristic of the variation is on an upward trend.

2. A luminance control device that controls luminance of a light source as backlight of a display panel, comprising:

a picture luminance detector for detecting luminance of an input picture signal;

a picture luminance storage for storing a plurality of luminance detected before the luminance of the picture signal detected by the picture luminance detector; and, a processor that detects variability that indicates intensity of variation of the luminance of the picture signal based on the plurality of luminance stored in the picture luminance storage and controls luminance of a light source based on the luminance of the picture signal detected by the picture luminance detector and the variability, wherein the processor calculates a directional characteristic of the variation of the picture luminance, and increases the amount of reduction in the light source luminance when a progress of a directional characteristic of the variation changes from an upward trend to a downward trend.

3. A luminance control device that controls luminance of a light source as backlight of a display panel, comprising:

a picture luminance detector for detecting luminance of an input picture signal;

a picture luminance storage for storing a plurality of luminance detected before the luminance of the picture signal detected by the picture luminance detector; and, a processor that detects variability that indicates intensity of variation of the luminance of the picture signal based on the plurality of luminance stored in the picture luminance storage and controls luminance of a light source based on the luminance of the picture signal detected by the picture luminance detector and the variability, wherein the processor calculates a directional characteristic of the variation of the picture luminance, and suppresses the amount of reduction in the light source luminance when a directional characteristic of the variation progresses in an order of a downward trend, a non-directional trend and an upward trend.

4. A luminance control method for controlling luminance of a light source as backlight of a display panel, comprising:

detecting luminance of an input picture signal;

storing step for storing a plurality of luminance detected before the luminance of the picture signal detected at the picture luminance detecting step;

detecting variability that indicates intensity of variation of the luminance of the picture signal based on the plurality of luminance stored at the picture luminance storing step and controls luminance of a light source based on the luminance of the picture signal detected at the picture luminance detecting step and the variability;

calculating a directional characteristic of the variation of the picture luminance, and changing the amount of reduction in the light source luminance, wherein the changing the amount of reduction in the light source luminance is selected from the group consisting of (a) increasing the amount of reduction in the light source luminance when the directional characteristic of the variation is on a downward trend and suppressing the amount of reduction in the light source luminance when the directional characteristic of the variation is on an upward trend, (b) increasing the amount of reduction in the light source luminance when a progress of a directional characteristic of the variation changes from an upward trend to a downward trend, and (c) suppressing the amount of reduction in the light source luminance when a directional characteristic of the variation progresses in an order of a downward trend, a non-directional trend and an upward trend.

5. A non-transitory luminance control program for causing a control device to execute a luminance control method according to claim 4.

* * * * *